US010242833B2

(12) United States Patent
Warne

(10) Patent No.: US 10,242,833 B2
(45) Date of Patent: Mar. 26, 2019

(54) SYSTEMS, APPARATUS, AND METHODS FOR ACCESSORY TRIPPING AND RESETTING OF ELECTRIC CIRCUIT BREAKERS

(71) Applicant: Siemens Aktiengesellschaft, München (DE)

(72) Inventor: Kevin R. Warne, Dawsonville, GA (US)

(73) Assignee: SIEMENS AKTIENGESELLSCHAFT, München (DE)

( * ) Notice: Subject to any disclaimer, the term of this patent is extended or adjusted under 35 U.S.C. 154(b) by 49 days.

(21) Appl. No.: 15/440,036

(22) Filed: Feb. 23, 2017

(65) Prior Publication Data

US 2018/0240635 A1 Aug. 23, 2018

(51) Int. Cl.

| | |
|---|---|
| ***H01H 21/30*** | (2006.01) |
| ***H01H 71/12*** | (2006.01) |
| ***H01H 71/50*** | (2006.01) |
| ***H01H 71/52*** | (2006.01) |
| ***H01H 71/02*** | (2006.01) |

(52) U.S. Cl.

CPC ..... *H01H 71/128* (2013.01); *H01H 21/30* (2013.01); *H01H 71/0228* (2013.01); *H01H 71/505* (2013.01); *H01H 71/52* (2013.01); *H01H 2235/01* (2013.01)

(58) Field of Classification Search

CPC ..... H01H 39/00; H01H 2071/046; H01H 71/1009; H01H 71/1027; H01H 71/504; H01H 71/526; H01H 71/7463

USPC ..... 200/293, 325, 337, 401, 5 A, 400, 244, 200/318

See application file for complete search history.

(56) References Cited

U.S. PATENT DOCUMENTS

| | | | | |
|---|---|---|---|---|
| 2,436,194 | A | 2/1948 | Bush | |
| 5,214,402 | A | 5/1993 | DiVincenzo et al. | |
| 6,452,470 | B1 * | 9/2002 | Malingowski | H01H 77/104 200/293 |
| 2007/0194869 | A1 | 8/2007 | Titus | |

FOREIGN PATENT DOCUMENTS

| | | | |
|---|---|---|---|
| CN | 204144131 | U | 2/2015 |
| DE | 102008064568 | A1 | 6/2010 |
| EP | 1098337 | A2 | 5/2001 |
| EP | 1298693 | A1 | 4/2003 |
| EP | 2546855 | A1 | 1/2013 |

* cited by examiner

*Primary Examiner* — Ahmed M Saeed

(57) ABSTRACT

Systems, apparatus, and methods for accessory tripping and resetting of circuit breakers are disclosed. Embodiments of the invention include a breaker handle; a breaker trip bar; an accessory trip device; an accessory pocket configured to receive the accessory trip device; and an adapter module disposed within the accessory pocket between the accessory trip device and the breaker handle, and coupled to the breaker handle, the breaker trip bar, and the accessory trip device, the adapter module including linkages configured to boost a force output by the accessory trip device. Numerous additional features and aspects are disclosed.

15 Claims, 12 Drawing Sheets left

Right left

Right

Reset
Right Side

Reset
Right Rear

Right
On

Left Front
On

Left Rear
On

Left Front
Tripped

Right Rear
Tripped

SYSTEMS, APPARATUS, AND METHODS FOR ACCESSORY TRIPPING AND RESETTING OF ELECTRIC CIRCUIT BREAKERS

FIELD

The present application relates to electric circuit breakers, and more specifically to systems, apparatus, and methods for accessory tripping and resetting of circuit breakers.

BACKGROUND

Generally, a circuit breaker is an automatically operated electrical switch designed to protect an electrical circuit from damage caused by overload or short circuit. A circuit breaker automatically has to open its contacts if an overcurrent condition is sensed. Therefore, a circuit breaker includes a trip unit which determines when the contacts are to open.

Some circuit breakers include provisions for accessory devices such as sensors, alarms, remote tripping devices, etc. These circuit breakers include a standardized "accessory pocket" that is adapted to receive various different modular accessory devices. Despite the modularity and standardization, many accessory trip devices will not function properly in different size circuit breakers. Thus, what is needed are systems, apparatus, and methods for an accessory trip device suitable for use in different size circuit breakers.

SUMMARY

In some embodiments, a circuit breaker with an accessory trip device is provided. Embodiments of the circuit breaker include a breaker handle; a breaker trip bar; an accessory trip device; an accessory pocket configured to receive the accessory trip device; and an adapter module disposed within the accessory pocket between the accessory trip device and the breaker handle, and coupled to the breaker handle, the breaker trip bar, and the accessory trip device, the adapter module including linkages configured to boost a force output by the accessory trip device.

In some other embodiments, an adapter module for an accessory trip device useable in an accessory pocket of a circuit breaker is provided. Embodiments of the accessory trip device include linkages configured to boost a force output by the accessory trip device; a coupling to a breaker handle; a coupling to a breaker trip bar; and a coupling to the accessory trip device.

In yet other embodiments, a method of tripping a circuit breaker is provided. The method includes providing a circuit breaker including an accessory pocket, the accessory pocket having mounted therein an accessory trip device coupled to the circuit breaker via an adapter module; resetting the accessory trip device via the adapter module in response the circuit breaker being reset; and increasing the trip force output by the accessory trip device via the adapter module in response to a trip initiated by the accessory trip device.

Still other features, aspects, and advantages of embodiments will become more fully apparent from the following detailed description, the appended claims, and the accompanying drawings by illustrating a number of exemplary embodiments and implementations. Embodiments may also be capable of other and different applications, and several details may be modified in various respects. Accordingly, the drawings and descriptions are to be regarded as illustrative in nature, and not as restrictive. The drawings are not necessarily drawn to scale. The description is intended to cover all modifications, equivalents, and alternatives falling within the spirit and scope of the claims.

DETAILED DESCRIPTION

Embodiments disclosed herein describe an adapter module for an accessory trip device for circuit breakers. Circuit breakers designed to accept accessory devices such as sensors, alarms, remote tripping devices, etc. provide users a cost effective means to customize or reconfigure circuit breakers and provide manufacturers a cost effective means to provide more product options to meet customer needs. As discussed above, these circuit breakers include a standardized "accessory pocket" that is adapted to receive various different modular accessory devices. In other words, a user can choose from among several different accessory devices for use in a given circuit breaker. However, even though different size (e.g., different amperage rating) circuit breakers may have the same standardized size accessory pockets, accessory trip devices are frequently specific to particular circuit breakers, for example, in order to meet the tripping force and stroke length specifications of the given circuit breaker. Thus, a manufacturer will typically resort to making different versions of the same accessory trip device for different size circuit breakers. Embodiments disclosed herein provide an adapter module for use with an accessory trip device that adapts the accessory trip device to be suitable for use with different size circuit breakers that have different tripping force and stroke length specifications. Thus, for example, the adapter module allows a single accessory trip device to be compatible with and used with an entire range of different size circuit breakers, e.g., ranging in size from approximately 40 amps to approximately 1500 amps.

Figure 1:
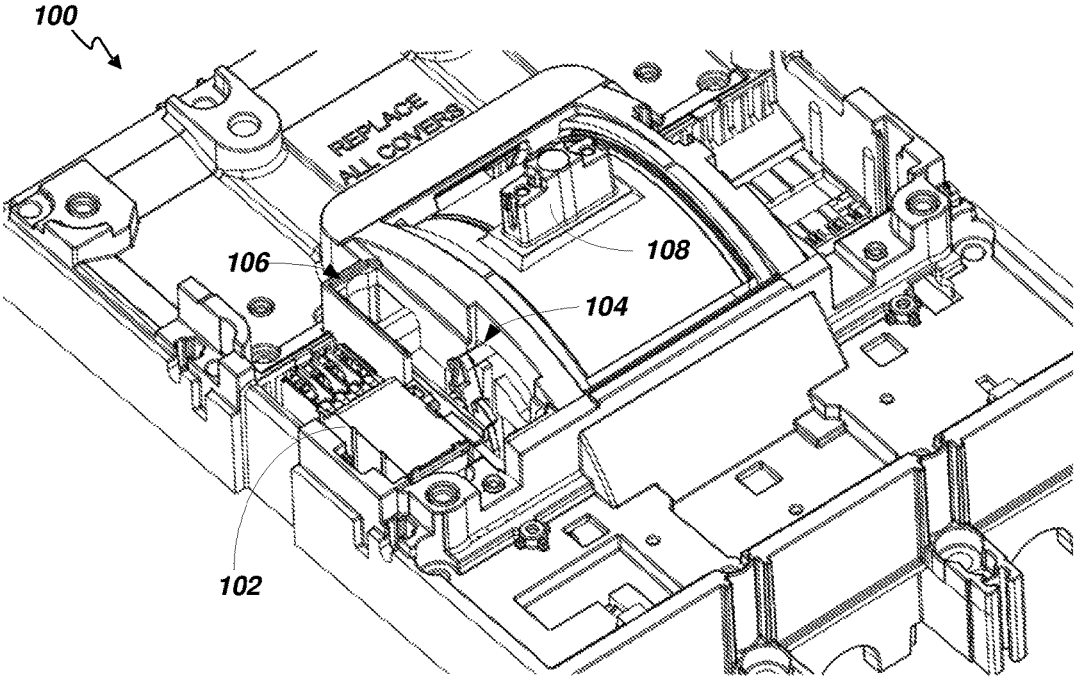
FIG. 1 is an isometric view diagram depicting an example circuit breaker according to some embodiments.
Figure 2:
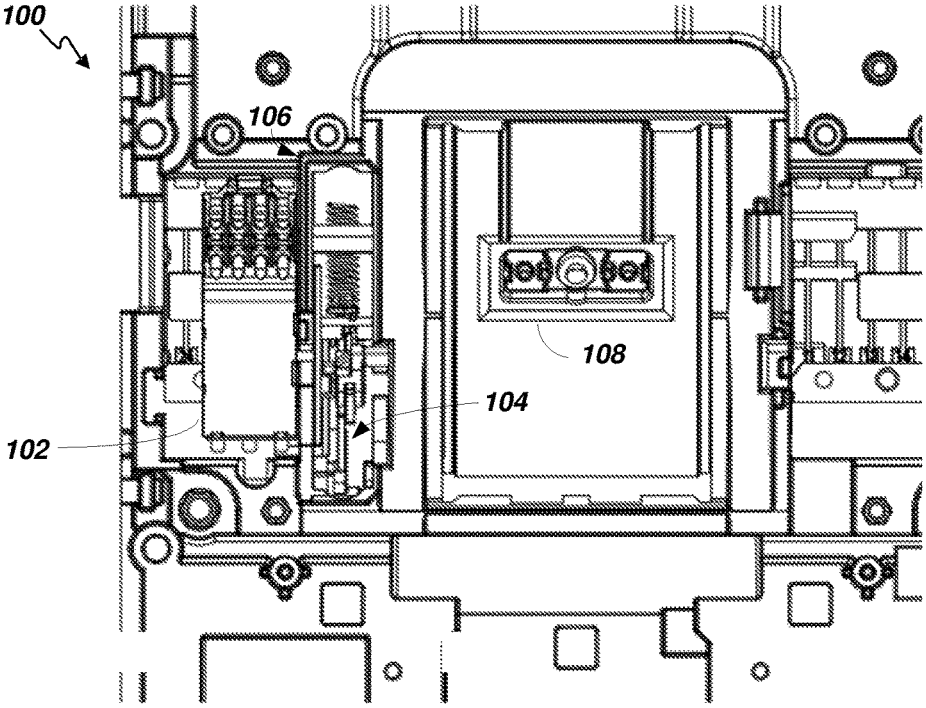
FIG. 2 is a top view diagram depicting an example circuit breaker according to some embodiments.
Figure 3:
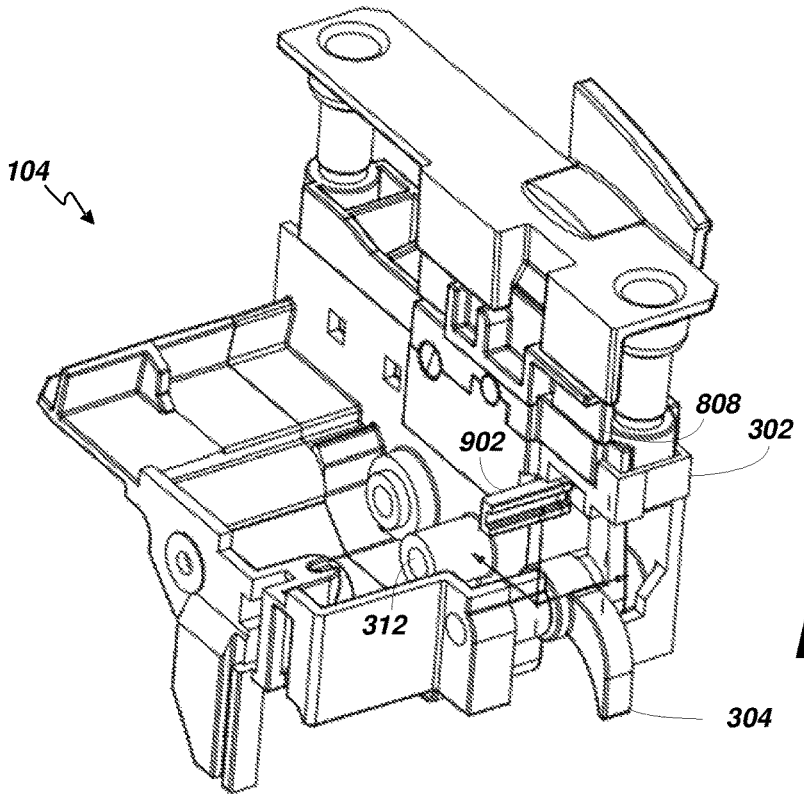
FIG. 3 is a left-side isometric view diagram depicting an example adapter module for an accessory trip device according to some embodiments.
Figure 4:
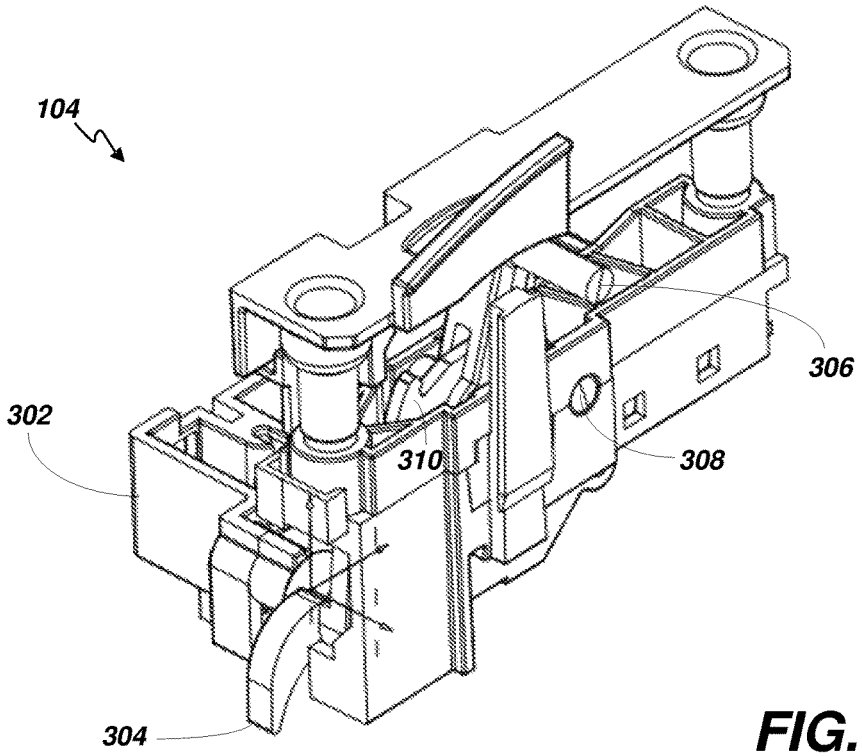
FIG. 4 is a right-side isometric view diagram depicting an example adapter module for an accessory trip device according to some embodiments.
Figure 5:
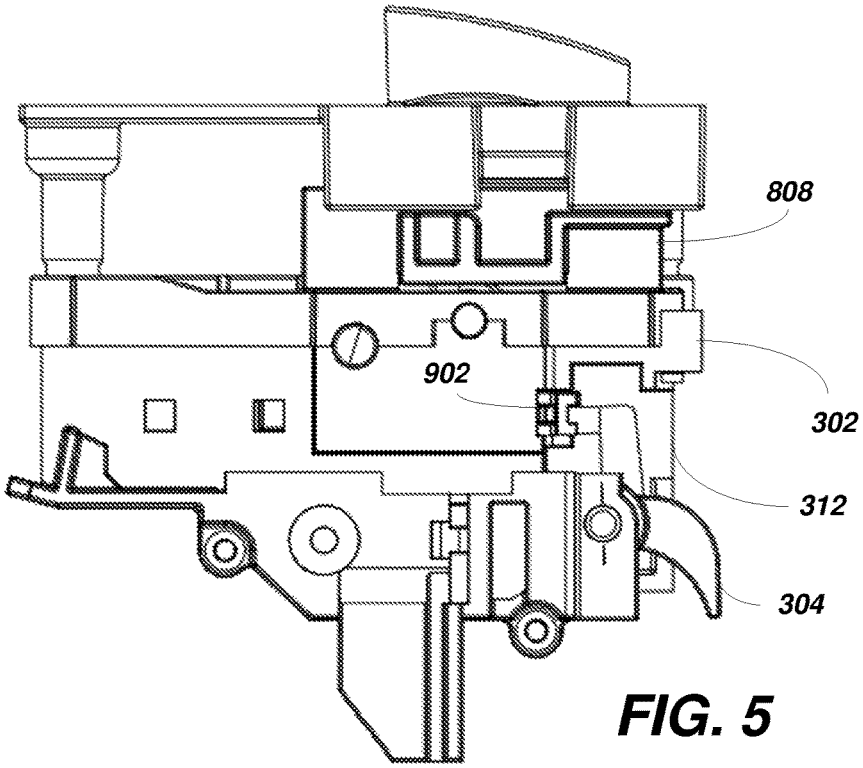
FIG. 5 is a left-side plan view diagram depicting an example adapter module for an accessory trip device according to some embodiments.
Figure 6:
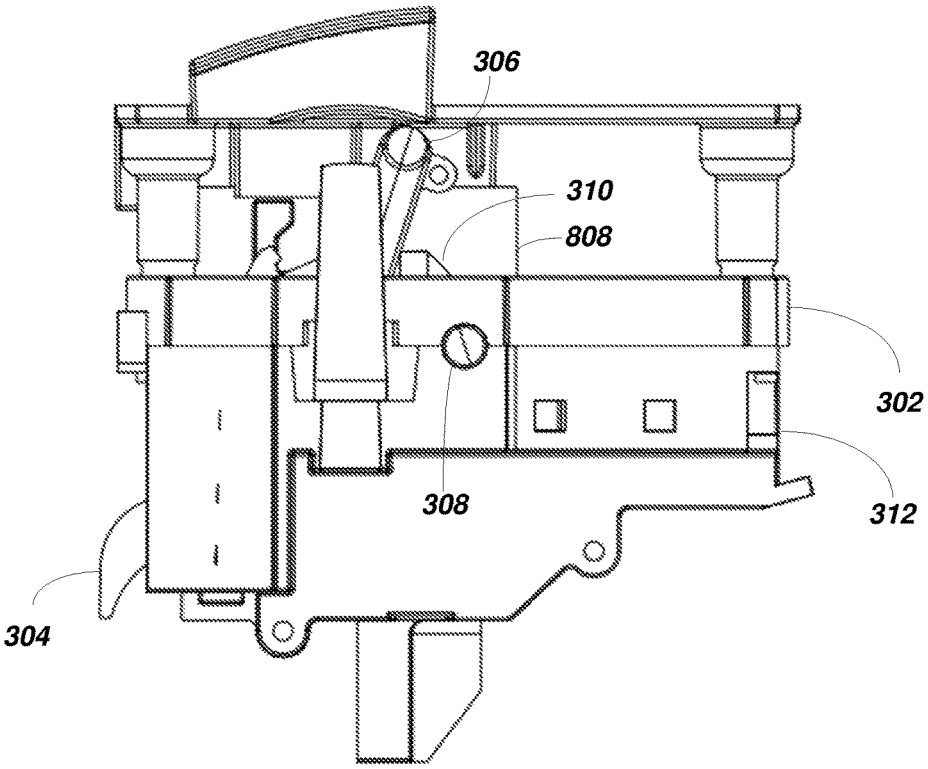
FIG. 6 is a right-side plan view diagram depicting an example adapter module for an accessory trip device according to some embodiments.
Figure 7:
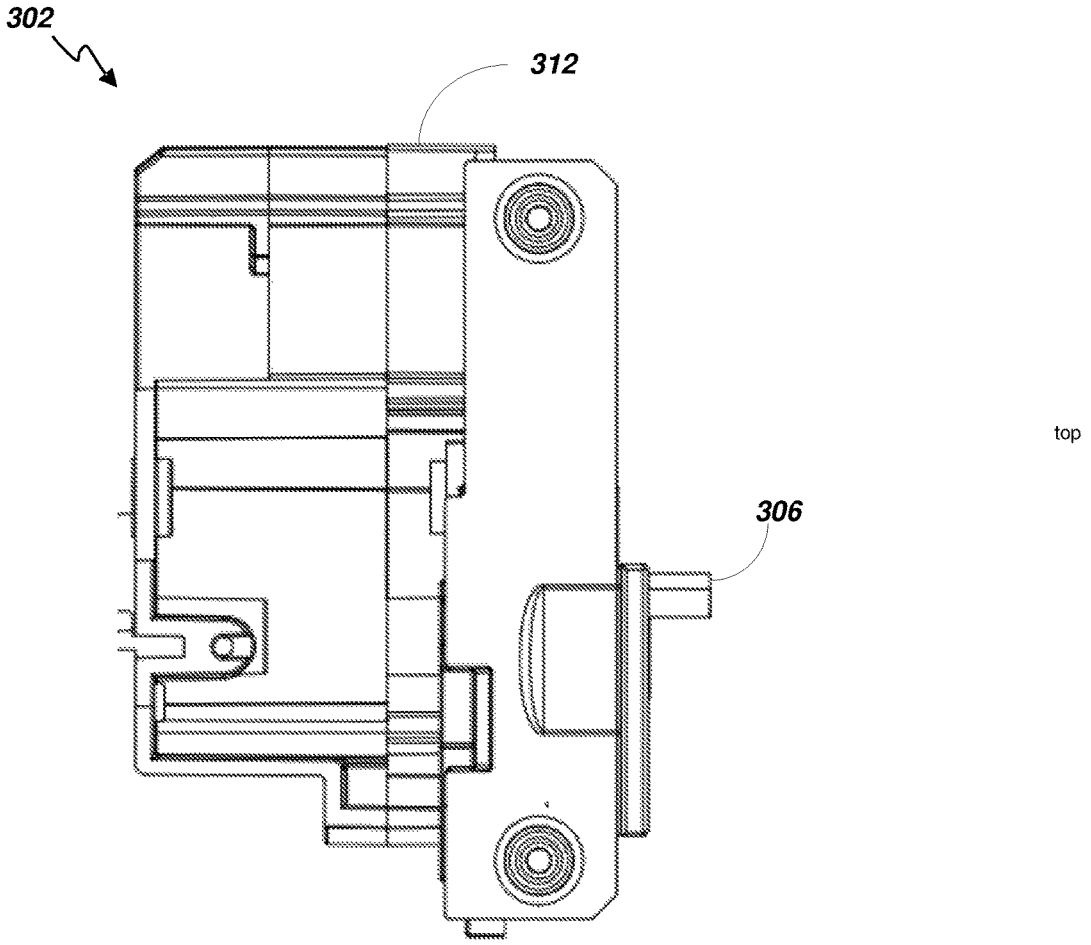
FIG. 7 is a top plan view diagram depicting an example adapter module for an accessory trip device according to some embodiments.

Turning now to FIGS. 1 and 2, isometric and top views respectively of a circuit breaker 100 including an accessory trip device 102 and an adapter module 104 according to embodiments disclosed herein, is depicted. The circuit breaker 100 includes an accessory pocket 106 that is configured to receive accessory devices such as the accessory trip device 102 and the adapter module 104 shown therein. The adapter module 104 is retained within the accessory pocket 106 with fasteners or friction fit retainers. The adapter module 104 is disposed between the accessory trip device 102 and the breaker handle 108. The adapter module 104 contacts (e.g., is coupled to) the circuit breaker 100 at the breaker handle 108 of the circuit breaker 100.

FIGS. 3 to 7 are left-side isometric, right-side isometric, left plan, right plan, and top views respectively of an example embodiment of adapter module 104. The adapter module 104 includes a housing (e.g. upper housing 302 and lower housing 312) that supports an internal multi-linkage system. The multi-linkage system provides a force and stroke multiplier for the accessory trip device 102. The multi-linkage system also provides for the resetting of the force and stroke multiplier and the accessory trip device. The multi-linkage system operates in unison with the circuit breaker for the reset and off states of the circuit breaker. The multi-linkage system works independently from the circuit breaker in the on and tripped states of the circuit breaker. Embodiments provide several advantages. The adapter module 104 allows a single accessory trip device 102 to be used with both smaller and larger circuit breakers 100. The compact multi-linkage system performs both functions of (1) resetting of the accessory trip device and (2) providing a trip force and stroke length booster for tripping larger circuit breakers. In addition, the multi-linkage system is configured to trip the booster with relatively low force. For example, the booster can be tripped with only approximately 20% to approximately 40% of the force used to trip the circuit breaker. In some embodiments, the booster can be tripped with only approximately 30% to approximately 35% of the force used to trip the circuit breaker. The orientation and design of the multi-linkage system allows the linkages to operate together for resetting, but operate independently for tripping. The multi-linkage system includes a trip lever 304, a reset arm 306, a trip shaft 308, a latch 310, lower housing 312, and other components described below.

Figure 8:
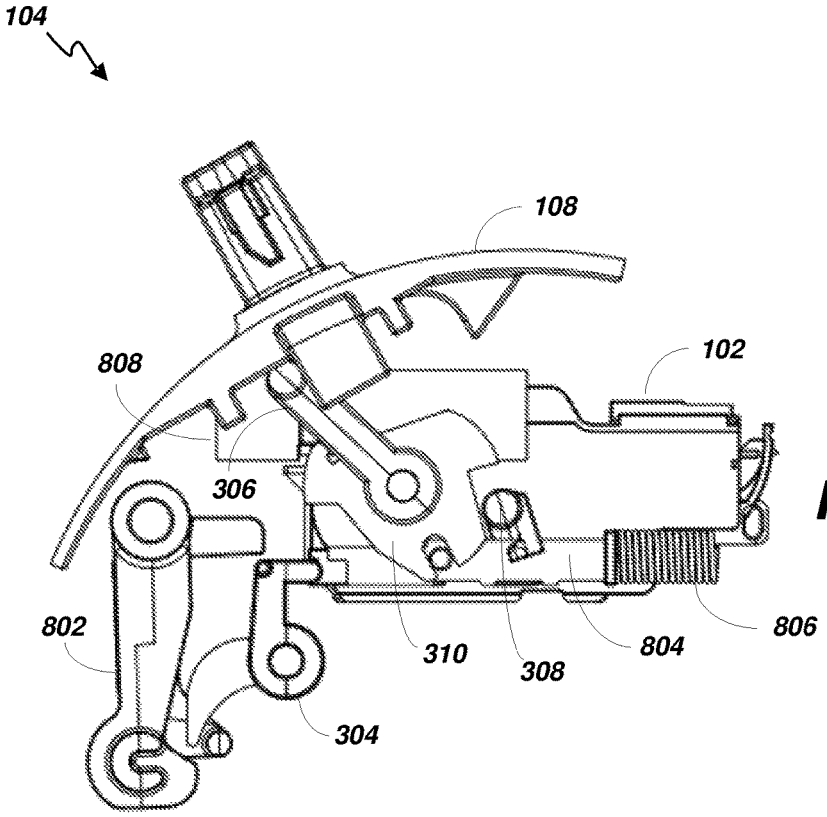
FIG. 8 is a right-side plan view diagram depicting a portion of an example adapter module in a reset state according to some embodiments.
Figure 9:
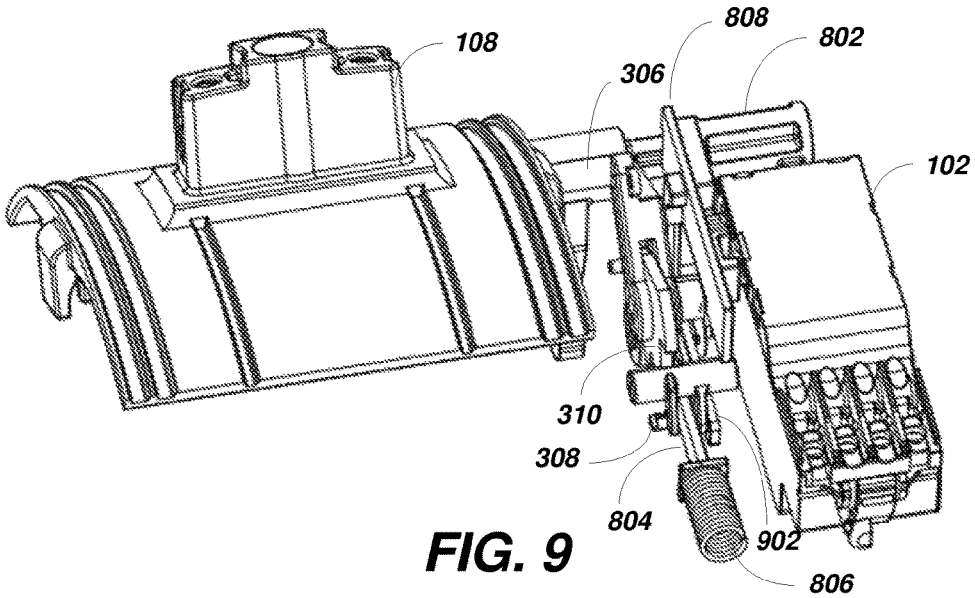
FIG. 9 is a right rear isometric view diagram depicting a portion of an example adapter module in a reset state according to some embodiments.

FIGS. 8 and 9 are right-side plan and right rear isometric views respectively of adapter module 104 in a reset state. The lower housing 302 of the adapter module 104 has been removed for clarity and the breaker handle 108 and accessory trip device 102 are shown for reference. When the breaker handle 108 is moved to the reset position it interacts with the reset arm 306. The reset arm 306 engages and rotates the latch 310 allowing the trip shaft 308 and latch bar 902 to move to their respective latching positions via a bias spring (not visible) attached to the trip shaft 308. The rotating latch 310 interacts with the trip bar 804, moving it back so as to compress the trip spring 806. Once the trip bar 804 has moved, the trip lever 304 can rotate to its reset position via a bias spring (not shown), removing the interaction with the breaker trip shaft 802 allowing the circuit breaker 100 to reset. In addition, while moving to the reset position, the reset arm 306 pushes on the reset slide 808. The sliding movement of the reset slide 808 provides the action to reset the accessory trip device 102.

Figure 10:
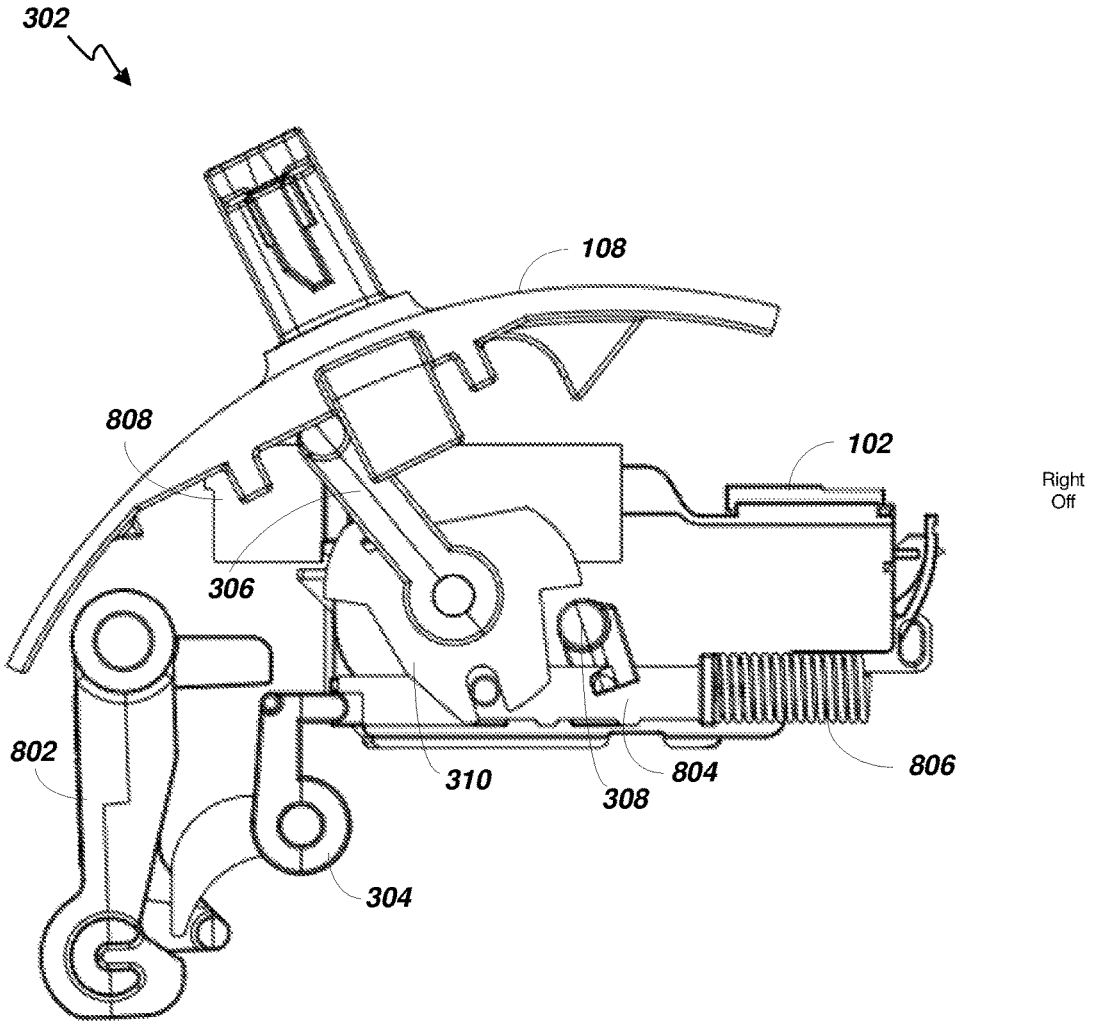
FIG. 10 is a right-side plan view diagram depicting a portion of an example adapter module in an off state according to some embodiments.
Figure 11:
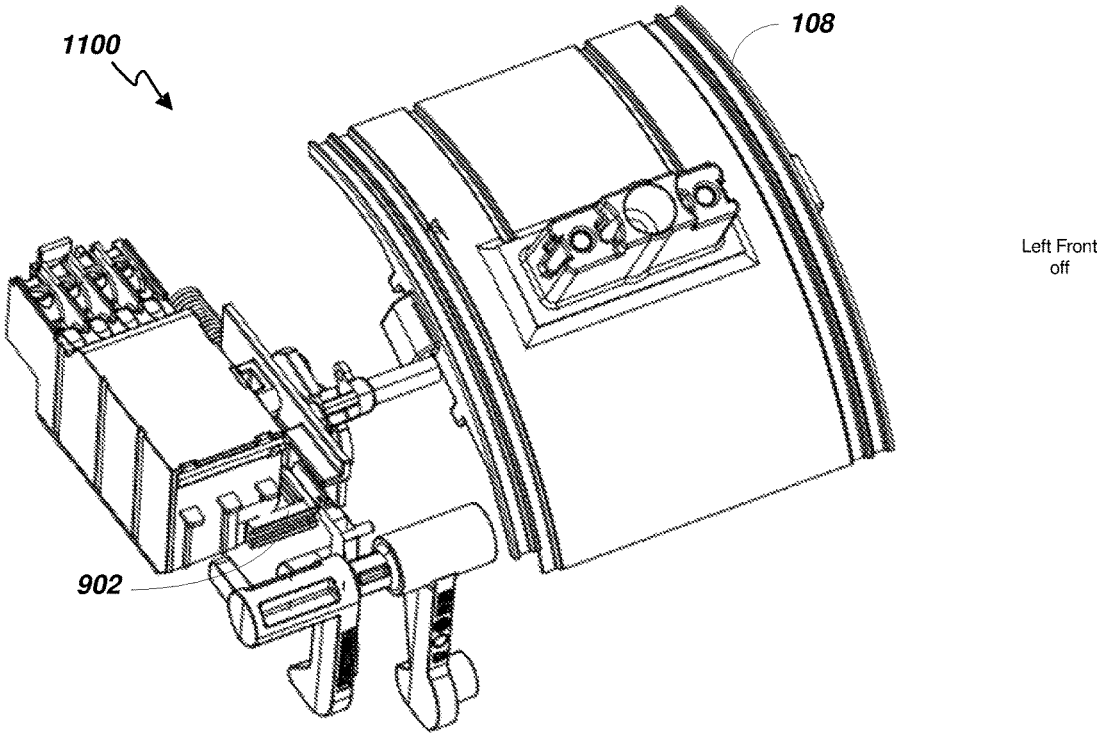
FIG. 11 is a left front isometric view diagram depicting a portion of an example adapter module in an off state according to some embodiments.
Figure 12:
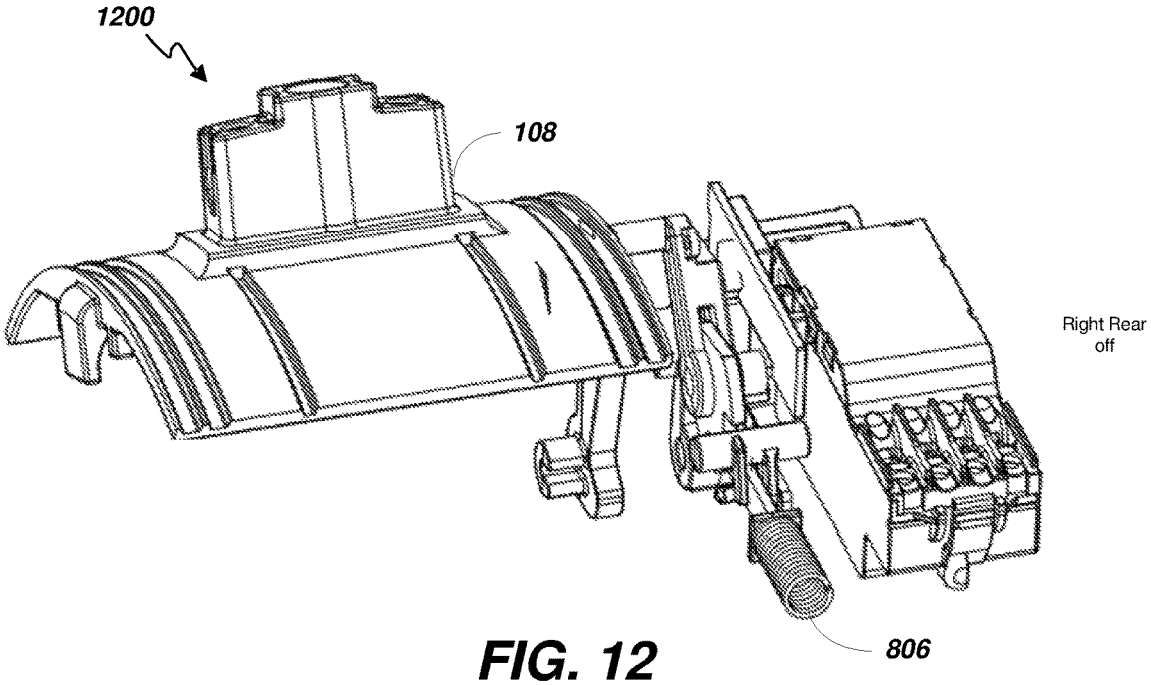
FIG. 12 is a right rear isometric view diagram depicting a portion of an example adapter module in an off state according to some embodiments.

FIGS. 10 to 12 are right-side plan, left front isometric, and right rear isometric views respectively of adapter module 104 in an off state. The lower housing 302 (FIG. 3) of the adapter module 104 has been removed for clarity and the breaker handle 802 and accessory trip device 102 are shown for reference. When the breaker handle 108 is in the off state, the breaker handle 108 maintains pressure on the reset arm 306. This pressure holds the reset arm 306 in an orientation that maintains the reset slide 808 in a position that will hold the accessory trip device 102 in a reset status. This orientation of the reset arm 306 also serves to maintain the latch 310, trip bar 804, trip spring 806, and trip lever 304 in a reset state. The adapter module 104 in this orientation prevents the linkages from being de-latched by any signal from the accessory trip device 102.

Figure 13:
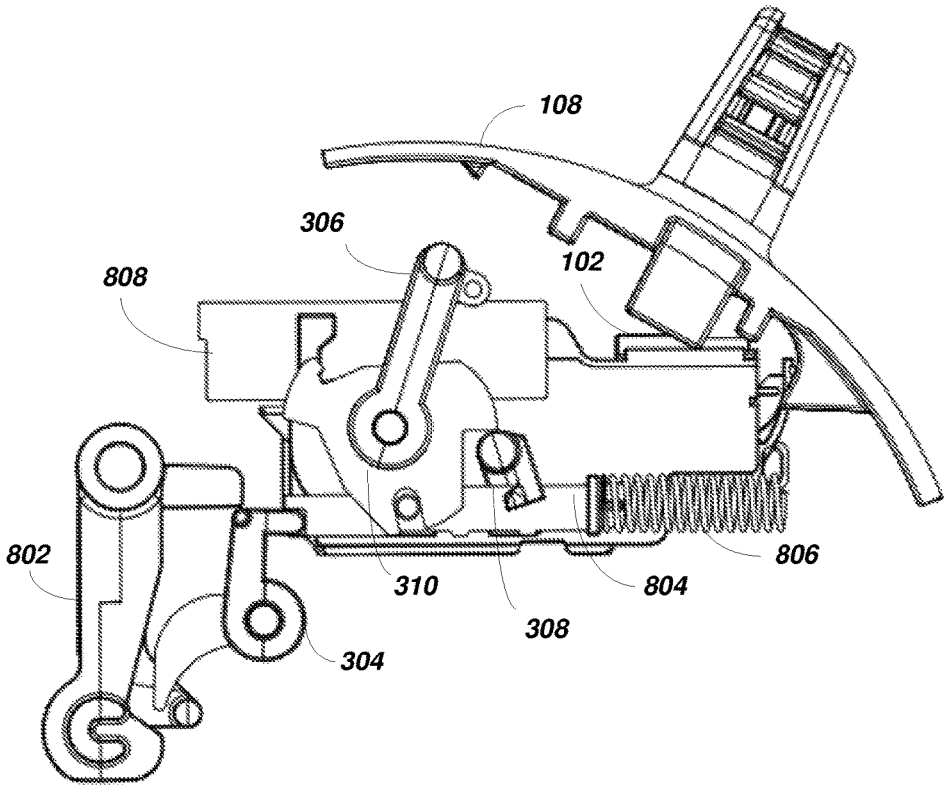
FIG. 13 is a right-side plan view diagram depicting a portion of an example adapter module in an on state according to some embodiments.
Figure 14:
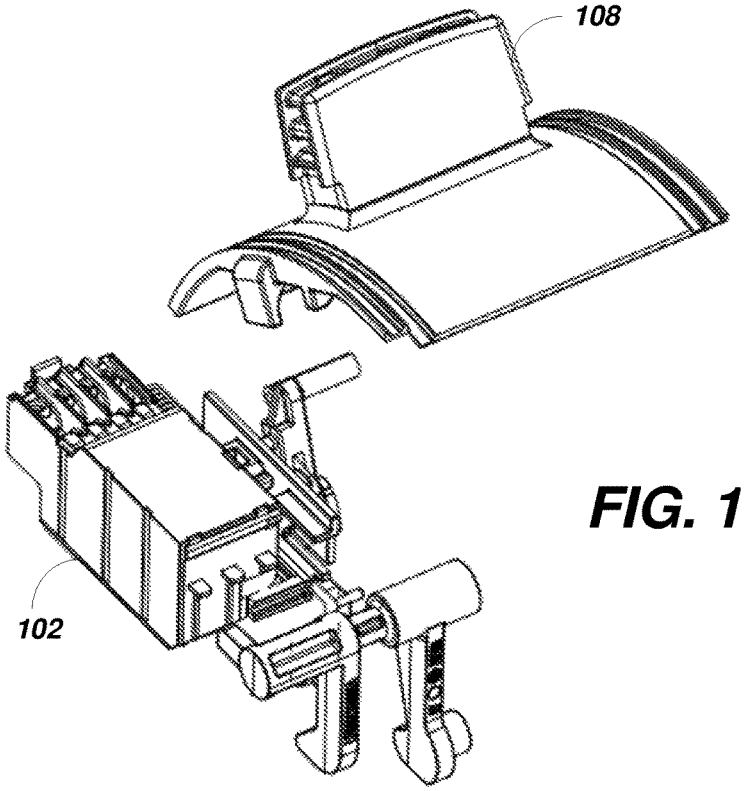
FIG. 14 is a left front isometric view diagram depicting a portion of an example adapter module in an on state according to some embodiments.
Figure 15:
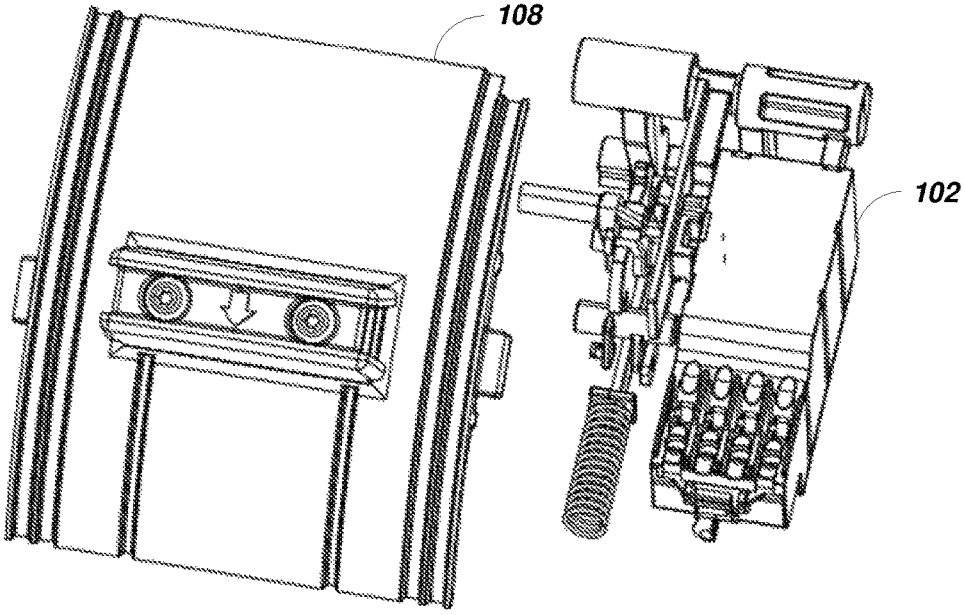
FIG. 15 is a right rear isometric view diagram depicting a portion of an example adapter module in an on state according to some embodiments.

FIGS. 13 to 15 are right-side plan, left front isometric, and left rear isometric views respectively of adapter module 104 in an on state. The lower housing 302 (FIG. 3) of the adapter module 104 has been removed for clarity and the breaker handle 802 and accessory trip device 102 are shown for reference. When the breaker handle 108 is moved to the on state, the breaker handle 108 no longer has any interaction with the reset arm 306, and the reset arm 306 is allowed to move to a neutral position via a bias spring (not shown). In this position the reset arm 306 has no interaction with any other linkage parts. The latch 310 now moves to a latched position with the trip shaft 308, where latch force is supplied by the trip spring 806 through the trip bar 804. The reset slide 808 is now a free moving part that will not offer any restriction of the operation of the accessory trip device 102.

Figure 16:
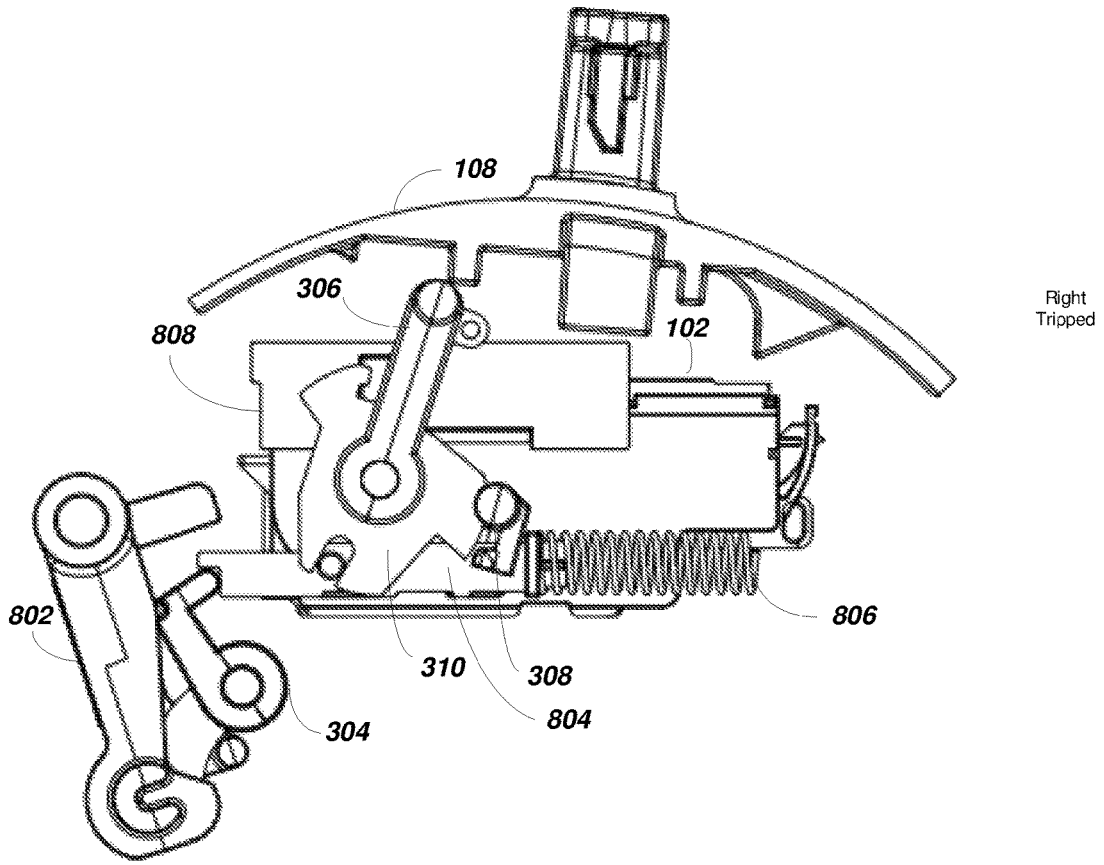
FIG. 16 is a right-side plan view diagram depicting a portion of an example adapter module in a tripped state according to some embodiments.
Figure 17:
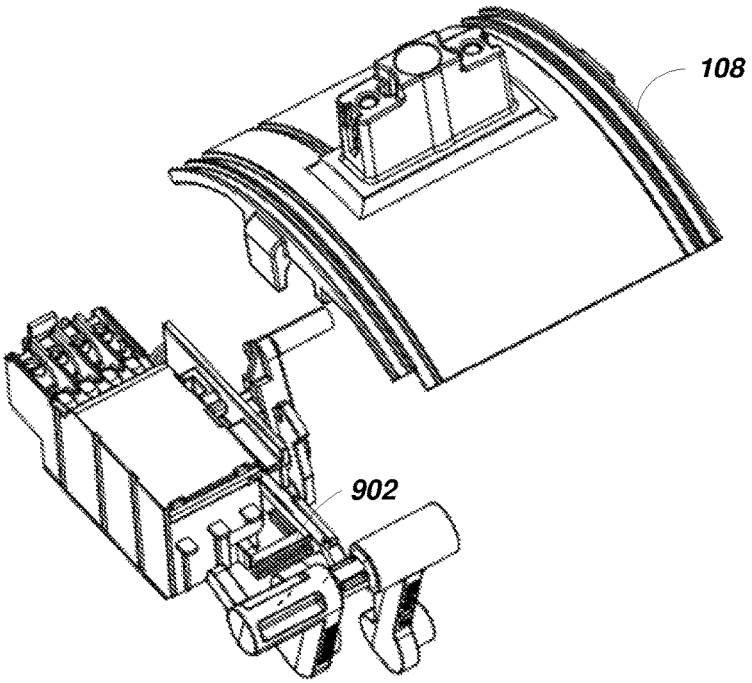
FIG. 17 is a left front isometric view diagram depicting a portion of an example adapter module in a tripped state according to some embodiments.
Figure 18:
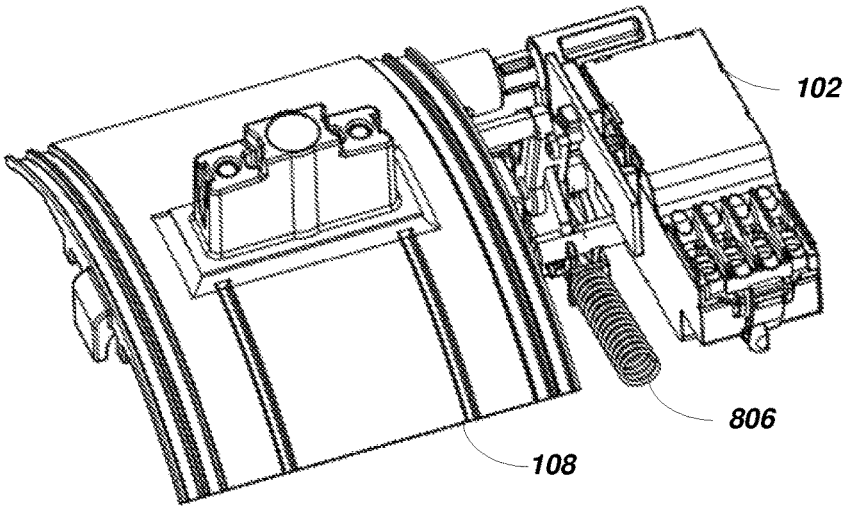
FIG. 18 is a right rear isometric view diagram depicting a portion of an example adapter module in a tripped state according to some embodiments.

FIGS. 16 to 18 are right-side plan, left front isometric, and right rear isometric views respectively of adapter module 104 in a tripped state. The lower housing 302 (FIG. 3) of the adapter module 104 has been removed for clarity and the breaker handle 802 and accessory trip device 102 are shown for reference. When the accessory trip device 102 is triggered it extends and actuates the latch bar 902 which in turn rotates the trip shaft 308. The rotating of the trip shaft 308 releases the latch 310, trip spring 806, and the trip bar 804. The release of the trip bar 804 interacts with and rotates the trip lever 304. The rotation of the trip lever 304 pulls on the breaker trip shaft 802 which de-latches the operating mechanism of the circuit breaker 100. The trigger of the accessory trip device 102 moves the reset slide 808 to its pre-reset position. This is done independently with the free moving reset slide 808 so as not to affect the force and stroke.

Figure 19:
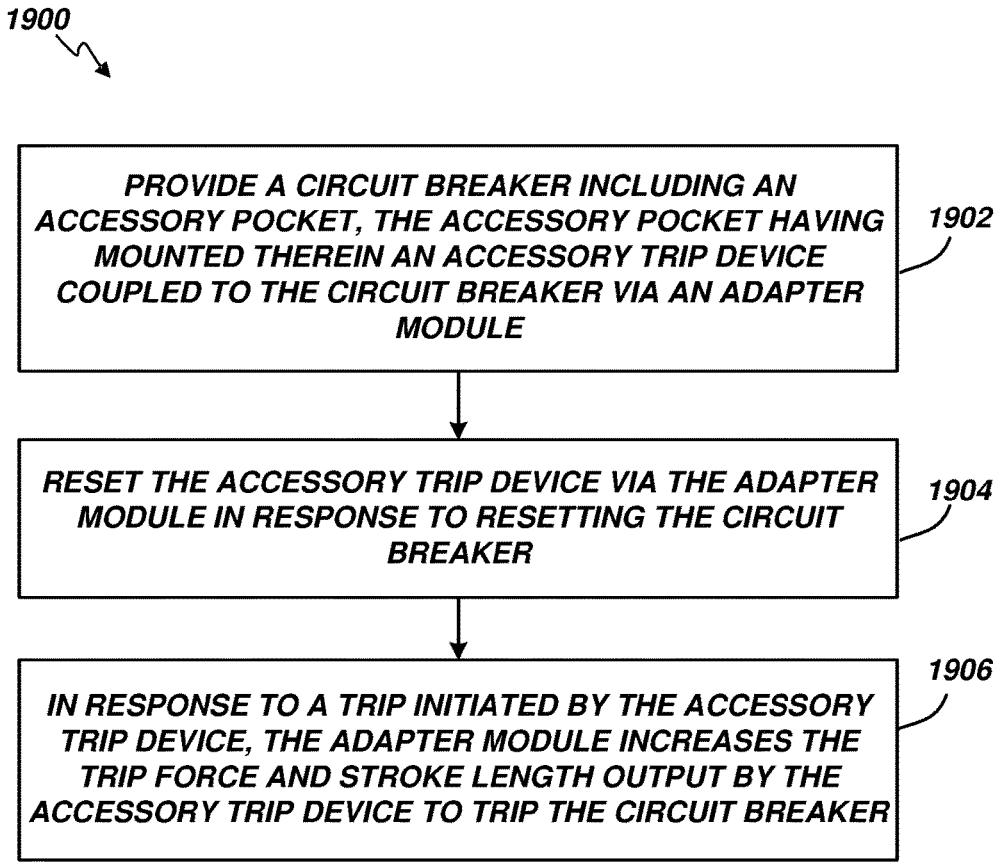
FIG. 19 is a flowchart illustrating an example method according to some embodiments.

FIG. 19 is a flow chart depicting and example method 1900 according to embodiments disclosed herein. The method 1900 includes providing a circuit breaker including an accessory pocket, the accessory pocket having mounted therein an accessory trip device coupled to the circuit breaker via an adapter module (1902). In response to resetting the circuit breaker, the adapter module resets the accessory trip device (1904). In response to a trip initiated by the accessory trip device, the adapter module increases the trip force and stroke length output by the accessory trip device to trip the circuit breaker.

Numerous embodiments are described in this disclosure, and are presented for illustrative purposes only. The described embodiments are not, and are not intended to be, limiting in any sense. The presently disclosed embodiments are widely applicable to numerous other embodiments, as is readily apparent from the disclosure. One of ordinary skill in the art will recognize that the disclosed embodiments may be practiced with various modifications and alterations, such as structural, logical, software, and electrical modifications. Although particular features of the disclosed embodiments may be described with reference to one or more particular embodiments and/or drawings, it should be understood that such features are not limited to usage in the one or more particular embodiments or drawings with reference to which they are described, unless expressly specified otherwise.

The present disclosure is neither a literal description of all embodiments nor a listing of features of the embodiments that must be present in all embodiments. The present disclosure provides, to one of ordinary skill in the art, an enabling description of several embodiments. Some of these embodiments may not be claimed in the present application, but may nevertheless be claimed in one or more continuing applications that claim the benefit of priority of the present application.

The foregoing description discloses only example embodiments. Modifications of the above-disclosed apparatus, systems and methods which fall within the scope of the claims will be readily apparent to those of ordinary skill in the art. Accordingly, while the embodiments have been disclosed in connection with exemplary embodiments thereof, it should be understood that other embodiments may fall within the intended spirit and scope, as defined by the following claims.

I claim:

1. A circuit breaker comprising:
a breaker handle;
a breaker trip bar;
an accessory trip device;
an accessory pocket configured to receive the accessory trip device; and
an adapter module disposed within the accessory pocket between the accessory trip device and the breaker handle, and coupled to the breaker handle, the breaker trip bar, and the accessory trip device, the adapter module including linkages configured to boost a force output by the accessory trip device, wherein the linkages include:
a reset arm coupled to the breaker handle;
a latch coupled to the reset arm;
a trip shaft coupled to the latch;
a latch bar and a bias spring coupled to the trip shaft;
an adapter trip bar coupled to the trip shaft;
a trip spring coupled to the adapter trip bar; and
a trip lever coupled to the adapter trip bar.

2. The circuit breaker of claim 1 wherein the linkages are further configured to lengthen a stroke length of the accessory trip device.

3. The circuit breaker of claim 1 wherein the linkages further include:
a reset slide coupled to the reset arm.

4. The circuit breaker of claim 3 wherein moving the breaker handle to the reset position interacts with the reset arm to engage the latch allowing the trip shaft and latch bar to move to a latched position via the bias spring, and rotates the latch to move the adapter trip bar to compress the trip spring and allow the trip lever to rotate to a reset position.

5. The circuit breaker of claim 4 wherein the trip lever rotating to the reset position decouples the trip lever from the breaker trip shaft and allows the circuit breaker to reset.

6. The circuit breaker of claim 5 wherein the interaction of the breaker handle with the reset arm also moves the reset slide to reset the accessory trip device.

7. An adapter module for an accessory trip device in an accessory pocket of a circuit breaker, the adapter module comprising:
linkages configured to boost a force output by the accessory trip device;
a coupling to a breaker handle;
a coupling to a breaker trip bar; and
a coupling to the accessory trip device, wherein the linkages include:
a reset arm coupled to the breaker handle;
a latch coupled to the reset arm;
a trip shaft coupled to the latch;
a latch bar and a bias spring coupled to the trip shaft;
an adapter trip bar coupled to the trip shaft;
a trip spring coupled to the adapter trip bar; and
a trip lever coupled to the adapter trip bar.

8. The adapter module of claim 7 wherein the linkages are further configured to lengthen a stroke length of the accessory trip device.

9. The adapter module of claim 7 wherein the linkages further include:
a reset slide coupled to the reset arm.

10. The adapter module of claim 9 wherein moving the breaker handle to the reset position interacts with the reset arm to engage the latch allowing the trip shaft and latch bar to move to a latched position via the bias spring, and rotates the latch to move the adapter trip bar to compress the trip spring and allow the trip lever to rotate to a reset position.

11. The adapter module of claim 10 wherein the trip lever rotating to the reset position decouples the trip lever from the breaker trip shaft and allows the circuit breaker to reset.

12. The adapter module of claim 11 wherein the interaction of the breaker handle with the reset arm also moves the reset slide to reset the accessory trip device.

13. An adapter module for an accessory trip device in an accessory pocket of a circuit breaker, the adapter module comprising:
a housing that supports an internal multi-linkage system, wherein the multi-linkage system provides a force and stroke multiplier for the accessory trip device,
wherein the multi-linkage system provides for resetting of the force and stroke multiplier for the accessory trip device, and
wherein the multi-linkage system operates in unison with the circuit breaker for RESET and OFF states of the circuit breaker and the multi-linkage system works independently from the circuit breaker in ON and TRIPPED states of the circuit breaker;
a coupling to a breaker handle;

a coupling to a breaker trip bar; and a coupling to the accessory trip device, wherein the multi-linkage system includes linkages that further comprising:

a reset arm coupled to the breaker handle, a latch coupled to the reset arm, a trip shaft coupled to the latch, a latch bar and a bias spring coupled to the trip shaft, an adapter trip bar coupled to the trip shaft, a trip spring coupled to the adapter trip bar, and a trip lever coupled to the adapter trip bar.

14. The adapter module of claim 13, wherein the linkages further including a reset slide coupled to the reset arm.

15. The adapter module of claim 13, wherein the linkages are further configured to lengthen a stroke length of the accessory trip device.

* * * * *